United States Patent [19]

McDonald

[11] Patent Number: 4,784,348

[45] Date of Patent: Nov. 15, 1988

[54] DISPENSER AND METHOD FOR APPLYING WEB-LIKE MATERIAL TO PACKAGING UNITS

[76] Inventor: Alex F. McDonald, 111 E. 216th St., Euclid, Ohio 44123

[21] Appl. No.: 920,370

[22] Filed: Oct. 20, 1986

[51] Int. Cl.[4] ..... B65H 75/40

[52] U.S. Cl. ..... 242/96; 242/99

[58] Field of Search ..... 242/96, 99; 242/68.3, 242/68.4

[56] References Cited

U.S. PATENT DOCUMENTS

| | | | |
|---|---|---|---|
| 4,179,081 | 12/1979 | Parry | 242/96 X |
| 4,248,392 | 2/1981 | Parry | 242/99 X |
| 4,444,364 | 4/1984 | Dahl et al. | 242/68.3 |
| 4,530,473 | 7/1985 | Parry | 242/99 X |
| 4,630,786 | 12/1986 | Lambert et al. | 242/96 |

OTHER PUBLICATIONS

Highlight Industries, Inc.-brochure on Stretch Band-it (2 pages), M. S . Plastics & Packaging Co., Inc.-brochure on Disposawrapper ®(2 pages).

Ultra Stretch Film-brochure on the Bemis Handler (1 page), date unknown.

*Primary Examiner*—John Petrakes
*Assistant Examiner*—Steven M. du Bois
*Attorney, Agent, or Firm*—Baldwin, Egan & Fetzer

[57] ABSTRACT

A method for manually applying web-like material, such as plastic stretch film in roll form, to packaging units, by winding the web material about the packaging units and controlling the tension and speed of unrolling of the roll of web material while applying the latter to the packaging units, and a simplified tool for accomplishing the method. The tool includes a head and a spindle projecting outwardly therefrom, with the head being adapted to mount a roll of the web material in non-movable relationship with respect to the head. An encircling wrap envelope of the web material is wound about the spindle in relatively rotatable relation therewith, and the tension and speed of unrolling of the web material from the roll while applying the web material to a packaging unit is accomplished by manually squeezing the wrap envelope of material on the spindle, to selectively cause a braking action between the spindle and the envelope.

12 Claims, 2 Drawing Sheets

DISPENSER AND METHOD FOR APPLYING WEB-LIKE MATERIAL TO PACKAGING UNITS

A wrap dispenser for applying web-like material, such as plastic stretch film, to packaging units, by wrapping the film thereabout, and an associated method for accomplishing the application of the plastic film to the packaging units, and more particularly a wrap dispenser which includes a head and a spindle fixedly secured to the head and projecting therefrom, and adapted to mount a roll of the plastic film or the like on the head, with the spindle being adapted to be wrapped with the plastic wrap in relatively rotatable relation, so that the tension and speed of unrolling of the film from the roll while applying the plastic wrap to a packaging unit or units is accomplished by manually squeezing the wrap envelope of plastic on the spindle, to selectively cause a braking action between the spindle and the wrap envelope.

BACKGROUND OF THE INVENTION

The application of plastic wrap and the like, such as for instance, plastic stretch wrap or tape to packaging units for banding the latter, by encircling the wrap about the packaging units, and utilizing an application tool, is well known in the art.

U.S. Pat. No. 4,179,081 dated Dec. 18, 1979 and U.S. Pat. No. 4,248,392 dated Feb. 3, 1981, in the name of John C. Parry. and entltled Apparatus for Application of Plastics Stretch Films, disclose apparatus which consists of a pair of insertable adapters for the ends of a cylindrical core of a roll of plastic stretch film, with a pair of tubular-like flexible grip means on the insertable adapters for use in controlling the tension and speed of unrolling of the film from the roll, during the application of the plastic film to packaging units. The rubber-like grip means become soiled, and may be misplaced or lost and therefore may not be readily available or conveniently locatable for use in applying the plastic film to the packaging units.

Also known in the art is a plastic film applicator tool or apparatus which includes a head and a spindle projecting from said head, with the head being rotatable relative to the spindle and having a selectively adjustable braking means therein for adjusting the rotational frictional coaction between the rotatable head and the spindle, so that as the head rotates relative to the spindle and dispenses a web of plastic stretch film about packaging units, the tension and speed of unrolling of the stretch film is controlled by the amount of tension initially placed upon the aforementioned braking mechanism disposed in the head. Such a tool is relatively complex and therefore relatively expensive and may be subject to mechanical problems as wear occurs, and is not conveniently adjustable when assembled with a roll of the film material.

SUMMARY OF THE INVENTION

The present invention provides a novel simplified wrap applying tool and associated method, and wherein the tool comprises a head adapted to be received in anchored relationship in the open core of a roll of flexible web or tape material, and a spindle fixedly projecting from the head and adapted to extend outwardly of the roll, and with there being provided during use a wrap envelope of the flexible web material encircling the spindle in relatively rotatable relation, with the wrap envelope being adapted to control the tension and the speed of unrolling of the material from the roll while applying the material to a packaging unit, by the operator's manual squeezing of the wrap envelope on the spindle, to selectively and conveniently cause a braking action between the spindle and the wrap envelope, thus providing a highly effective tool for applying plastic wrap and the like to a packaging unit or units, and a tool that is less costly as compared to those presently available in the marketplace.

Accordingly, an object of the invention is to provide a novel apparatus or tool for applying a roll of web material such as plastic wrap or tape, to packaging units, and enabling control of the tension and speed of unrolling of the wrap from the roll.

A still further object of the invention is to provide a tool of the aforementioned type consisting of a head and spindle fixedly secured to the head, and projecting therefrom, with the head being adapted to be received within the open core of a roll of the plastic film or web material, and with the spindle being adapted to have a rotatable wrap envelope of the flexible web material wrapped thereabout in encircling relationship, for providing for manual squeezing of the envelope by the tool operator during application of the web of material from the roll to a packaging unit, to thus selectively cause a braking action between the spindle and the wrap envelope, to effectively control the tension and speed of unrolling of the roll.

A still further object of the invention is to provide a tool of the aforementioned type which includes an enlarged end thereon for retaining on the spindle the associated wrap envelope of flexible material, with the enlarged end being preferably removable from the associated end of the spindle so that the wrap envelope can be readily separated from the spindle if desired, and replaced by a new wrap envelope.

A still further object of the invention is to provide a novel method for manually applying plastic film to packaging units utilizing an apparatus or tool comprising a head and a spindle anchored to the head and projecting therefrom, with the head being adapted to be received within the open core of a roll of plastic film material or the like and with a wrap envelope of the plastic film encircling the spindle in relatively rotatable relation, so that the tool operator can squeeze the wrap envelope of film on the spindle to selectively cause a braking action between the spindle and the envelope, thus selectively controlling the tension and speed of unrolling of the film from the roll while applying the film to a packaging unit.

A still further object of the invention is to provide a method of the latter type which includes an arrangement for selectively and rapidly changing the wrap envelope of film about the spindle, in the event that the latter becomes soiled or inoperable.

Other objects and advantages of the invention will be apparent from the following description taken in conjunction with the accompanying drawings wherein:

DESCRIPTION OF PREFERRED EMBODIMENT AND ALTERNATE EMBODIMENT

Figure 1:
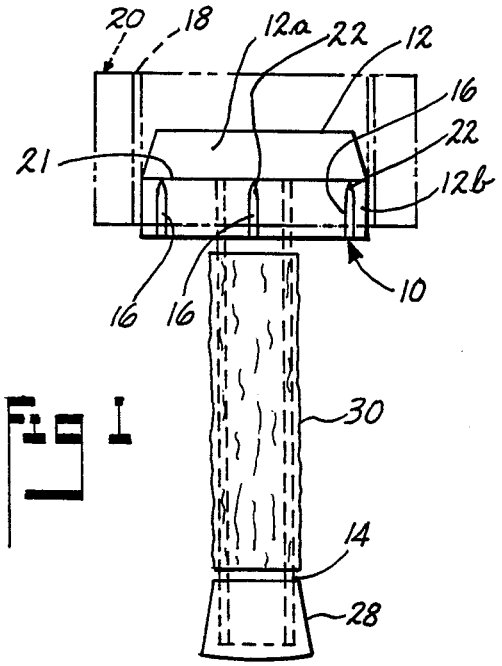
FIG. 1 is a side elevational view of an applicator tool embodying the invention and with the head of the tool being inserted into the open core of a roll of plastic film material, the latter being shown in phantom lines.
Figure 2:
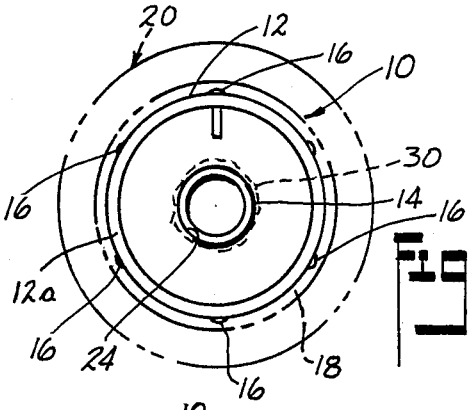
FIG. 2 is a top plan view of the tool and roll of plastic film illustrated in FIG. 1.
Figure 3:
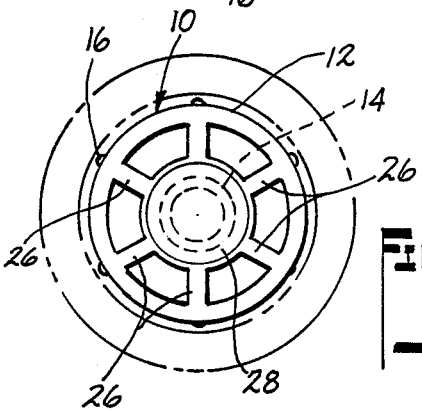
FIG. 3 is a bottom plan view of the assembly illustrated in FIG. 1.
Figure 4:
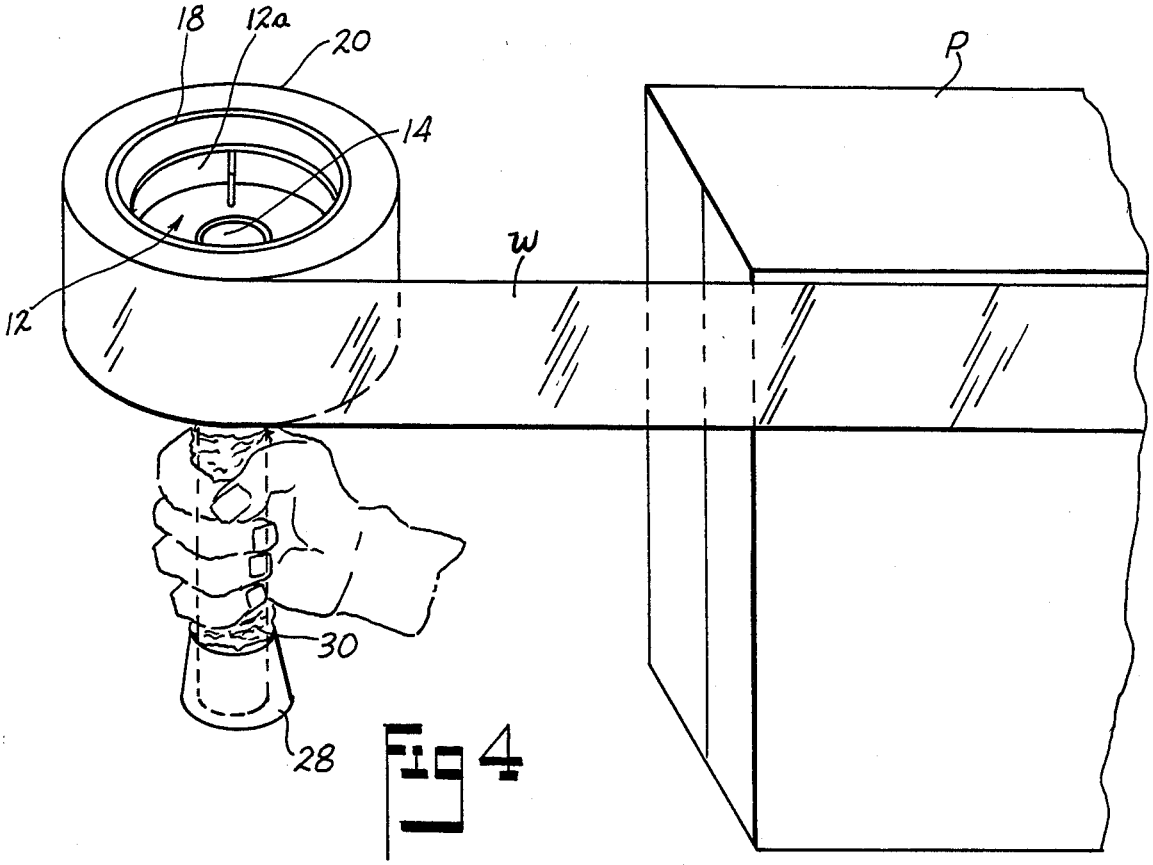
FIG. 4 is a generally diagrammatic perspective illustration, showing the application of the web of material from the roll to a packaging unit, and showing the tool operator's hand squeezing the wrap envelope of plastic material encircling the spindle for selectively causing a braking action between the spindle and the envelope, to thus provide for controlling the tension and speed of unrolling of the web material from the roll, while applying the material to the packaging unit.

Referring now again to FIGS. 1 through 4, there is illustrated a tool 10 embodying the invention and comprising a head 12 and a spindle 14 anchored to the head in generally axial relationship therewith and extending therefrom.

The tool head 12 may include an upper frusto-conical section 12*a* and a lower generally cylindrically section 12*b* disposed in juxtaposed integral relationship with section 12*a*.

In the embodiment illustrated, the head and specifically the lower section 12*b* is provided with a plurality of spaced ribs 16 formed on the head and projecting laterally thereof, with the ribs being adapted to frictionally embed somewhat into the paperboard core 18 of a roll 20 of the web or tape-like material, such as for instance plastic stretch film, and to prevent relative rotary movement of the roll 20 relative to the tool 10. The ribs 16, in the embodiment illustrated, commence adjacent the lower end of the head and extend upwardly toward the upper end, and terminate substantially at the juncture line 21, with the upper ends of the ribs possessing a generally pointed configuration (as at 22) which merge smoothly with the adjoining surface of the frusto-conical surface of the head, so that the embedding of the ribs into the inner surface of the core 18 of the roll is facilitated during movement of the head axially into the core, to mount the roll 20 on the head of the tool.

The spindle 14 and the head 12 are preferably formed of plastic material, with the head as molded, including an opening 24 therein adapted to snugly receive the upper end of the spindle 14 in frictionally held relationship, so that rotary movement of the head relative to the spindle 14 is prevented. Adhesive means, or heat bonding can be utilized to integrally attach the head to the spindle, if so desired or required, but it will be seen that the spindle 14 and the head 12 can be conveniently formed as separate parts and then assembled together. The head may also include radially extending ribs 26 (FIG. 3) which strengthen the head and reduce the weight of the tool.

The lower end of spindle 14 is preferably provided with an enlarged retainer member 28 which in the embodiment illustrated may comprise a plastic or rubber cap, adapted for frictional engagement with the distal end of the spindle, thereby detachably retaining the cap 28 to the spindle.

In accordance with the invention, the spindle is adapted to be wrapped with wrap envelope 30 formed of the flexible plastic or web-like material of the roll 20, encircling the spindle between the removable cap 28 and the head 12. Such wrap envelope 30 may be formed of a preselected number of layers of the wrap material of roll 20, wrapped relatively loosely about the generally smooth surfaced spindle. Such wrap envelope is of course flexible, and can be selectively squeezed by the hand of the operator (FIG. 4) during application of the web W of roll material to the packaging unit or units P, so as to selectively control the tension and speed of unrolling of the web from the roll 20, while applying the web to the packaging unit or units. This squeezing of the wrap envelope 30 of course selectively causes a braking action between the spindle and the envelope 30 to control the aforementioned tension and speed. Such an arrangement prevents injury to the operator's hands which could occur due to friction, and no gloves are required by the operator to apply the plastic wrap or tape W to the packaging unit P.

If the wrap envelope 30 becomes soiled or compressed to an extent that it begins to undesirably frictionally engage the spindle, the cap 28 can be readily removed from the spindle proper, and the wrap envelope 30 removed by sliding or peeling it off the spindle end, and then a new wrap envelope of the roll material can be substituted for the old wrap envelope.

Figure 5:
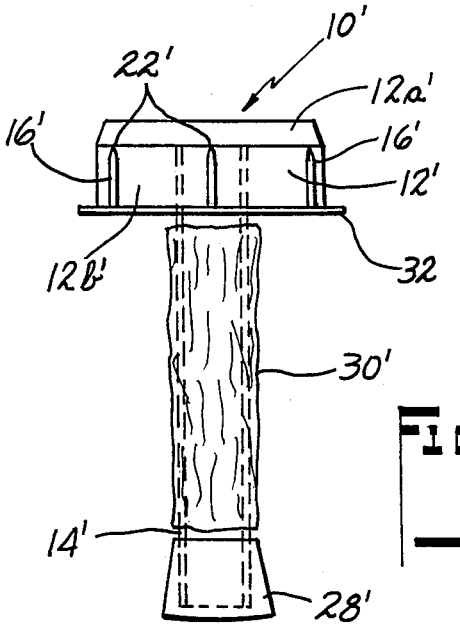
FIG. 5 is a side elevational view generally similar to FIG. 1, but illustrating a modified form of applicator tool.
Figure 6:
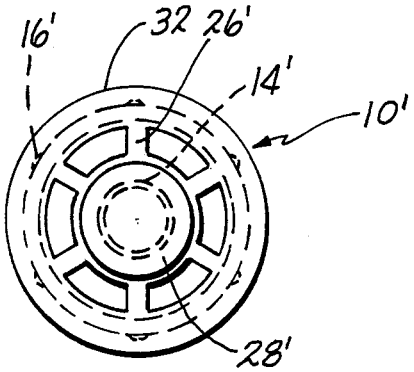
FIG. 6 is a plan view of the tool illustrated in FIG. 5, taken from the bottom thereof.

Referring now to FIGS. 5 and 6, there is shown a modified embodiment of applicator tool 10' wherein like reference numbers are applied to like parts except with the prefix prime applied thereto.

In this embodiment of tool 10', the cylindrical portion 12*b'* is higher at least with respect to the frusto-conical section 12*a'* as compared to the tool illustrated in FIGS. 1 to 4. Moreover, the FIGS. 5 and 6 tool head 12' is provided with a lip or shoulder 32 thereon at the lower end of the head to positively limit the entry of the head into the open core of a roll 20 of web-like material, since such lip or shoulder will engage the core of the roll if the head is forced the maximum amount into the core.

In other respects, tool 10' may be generally similar to that of the first described embodiment, and is adapted to operate in a generally similar manner.

From the foregoing description and accompanying drawings, it will be seen that the invention provides a novel applicator tool for manually applying a web of elongated flexible stock material, such as for instance plastic stretch film, to packaging units or the like, and which tool can be readily assembled with a roll of the web material, and when a wrap envelope of the flexible material of the roll is applied to the tool spindle in relatively rotatable relation, such wrap envelope of material can be effectively utilized by the operator, to selectively control the tension and speed of unrolling of the web material from the roll while applying the web material to a packaging unit or units, or the like, and by manually squeezing the wrap envelope of web material on the spindle, to selectively cause a braking action between the spindle and the wrap envelope. The invention also provides a novel method for manually applying a flexible web of material, such as plastic film, to a packaging unit or units, by inserting into the open core of a roll of the flexible material, an applicator tool having a head and a spindle anchored to the head, and projecting outwardly therefrom, and relatively loosely wrapping a selected amount of the flexible material from the roll about the projecting portion of the spindle, to form an encircling wrap envelope of flexible material, which is rotatable relative to the projecting portion of the spindle, and then controlling the tension and speed of unrolling of the flexible web material from the roll while applying the web material to a packaging unit or units, by manually and selectively squeezing the wrap envelope of flexible material on the spindle, to selectively cause a braking action between the spindle and the wrap envelope.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. A method for manually applying flexible web material, such as plastic film or the like, to packaging units comprising, providing a roll of said flexible material having an open core, inserting into the core in frictional engagement therewith a spindle which then projects out one end of said core, relatively loosely wrapping a selected amount of said flexible material about said projecting portion of said spindle to form an encircling envelope of flexible material which is rotatable relative to said projecting portion of said spindle, and controlling the tension and speed of unrolling of said flexible web material from said roll while applying said flexible material to a packaging unit by manually squeezing said envelope of flexible material on said spindle to selectively cause a braking action between said spindle and said envelope, and including removing said envelope from said spindle by slipping it off the distal end thereof, and then replacing said envelope by wrapping a selected amount of new roll flexible material about said spindle to form a new encircling envelope of flexible material as a replacement for the original envelope of flexible material.

2. A tool for manually applying a web of elongated flexible stock material to units for packaging or banding the same comprising, a head adapted to be forced frictionally into an open core of a roll of the flexible material with the core being non-rotatable with respect to the roll of flexible material, and a spindle fixedly projecting from said head and adapted to extend outwardly of the roll, said spindle having an enlarged end thereon for retaining on said spindle an associated wrap envelope of the flexible material, encircling said spindle in relatively rotatable relation, said wrap envelope of material being adapted to control the tension and the speed of unrolling of the flexible material from the roll while applying the flexible material to a unit for packaging or the like by manaully squeezing the wrap envelope of flexible material on said spindle to selectively cause a braking action between said spindle and said wrap envelope.

3. A tool in accordance with claim 2 wherein said enlarged end is removable from the associated end of said spindle, and when on said spindle end, prevents said wrap envelope from sliding off said end of said spindle.

4. A tool in accordance with claim 2 wherein said head includes ribs projecting laterally thereof and adapted to frictionally embed into the core of the roll of material, for locking the head to the roll against relative rotation.

5. A tool in accordance with claim 2 wherein said head includes, when viewed in side elevation, a generally frusto-conical configuration section for facilitating the insertion of said head into the open core of the roll.

6. A tool in accordance with claim 4 wherein said head includes an upper end and a lower end, said ribs extending from adjacent said lower end toward said upper end, said ribs at their upper ends possessing a generally pointed configuration which merges with the adjoining surface of the head, so that the embedding of said ribs into the inner surface of the core of the roll is facilitated during axial movement of said head into the core to accomplish assembly of the roll with said tool.

7. A tool in accordance with claim 2 wherein said head includes an upper end and a lower end, and comprises, when viewed in side elevation, a generally frusto-conical upper section and a generally cylindrical lower section abutting said upper section, and ribs projecting laterally of said head and disposed on said lower section with the upper ends of said ribs terminating substantially at said intersection.

8. A tool in accordance with claim 2 wherein said enlarged end is removable from the remainder of said spindle, and comprises a flexible cap which frictionally engages the underlying surface of said spindle but which is removable therefrom by pulling outwardly on said cap.

9. A tool in accordance with claim 2 wherein said head and spindle are formed of plastic.

10. A tool in accordance with claim 2 wherein said head includes an upper end and a lower end, and said head is provided with a lip at said lower end thereof, for positively limiting the extent of entry of said head into the open core of the roll.

11. A tool in accordance with claim 2 wherein said head and said spindle are formed as separate parts and then said spindle is assembled into anchored coaction with said head.

12. A tool in accordance with claim 11 wherein said head includes an axial opening therein and said spindle comprises a tubular-like smooth surfaced member, one end of which is forced into said opening in frictionally anchored coaction with said head, said head being of molded plastic and including radially extending ribs.

* * * * *